US006834467B2

(12) United States Patent
Gulbrandsen et al.

(10) Patent No.: US 6,834,467 B2
(45) Date of Patent: Dec. 28, 2004

(54) FREE FORM CEILING

(75) Inventors: Peder Gulbrandsen, Aurora, IL (US); James J. Lehane, Columbia Station, OH (US); Alan C. Wendt, Barrington, IL (US)

(73) Assignee: USG Interiors, Inc., Chicago, IL (US)

( * ) Notice: Subject to any disclaimer, the term of this patent is extended or adjusted under 35 U.S.C. 154(b) by 82 days.

(21) Appl. No.: 10/044,374

(22) Filed: Jan. 10, 2002

(65) Prior Publication Data

US 2003/0205016 A1 Nov. 6, 2003

(51) Int. Cl.[7] ..... E04B 2/00
(52) U.S. Cl. ..... 52/506.07; 52/506.06
(58) Field of Search ..... 52/506.07, 506.08, 52/506.09, 506.06, 80.1, 384, 506.01, 587; D25/58

(56) References Cited

U.S. PATENT DOCUMENTS 3,333,378 A * 8/1967 Jahn
3,394,506 A * 7/1968 Thompson
3,968,609 A * 7/1976 Deutsch et al. ..... 52/245
3,982,361 A * 9/1976 Deutsch et al. ..... 52/80.1
4,471,596 A * 9/1984 Deaton ..... 52/668
4,548,010 A 10/1985 Hintsa ..... 52/484
4,724,181 A * 2/1988 Mingenbach ..... 428/174
5,088,261 A * 2/1992 Mieyal ..... 52/729
5,428,930 A 7/1995 Bagley et al. ..... 52/506.07
5,699,641 A * 12/1997 Tinen ..... 52/506.07
6,047,512 A 4/2000 Wendt et al. ..... 52/506.07
6,374,564 B1 * 4/2002 Fletterick et al. ..... 52/506.07
D464,737 S * 10/2002 Gulbrandsen et al. ..... D25/58

* cited by examiner

*Primary Examiner*—Gwendolyn Baxter
(74) *Attorney, Agent, or Firm*—Barnes & Thornburg LLP, Michael M. Geoffrey, David F. Janci

(57) ABSTRACT

A free form ceiling panel for suspended ceiling systems that creates the appearance of moguls. The free form ceiling panels fit into a suspended ceiling grid. The free form ceiling is a grid system made up of curving tee members and preformed curved panels. The grid members curve in predefined radii into which formed panels are placed. The frame is formed from individual curved grid members that meet at their respective ends to form intersections. The grid members are rigid preformed members that are curved so that when interconnected a curve is formed.

12 Claims, 9 Drawing Sheets

FREE FORM CEILING

BACKGROUND OF THE INVENTION

The present invention relates generally to suspended ceiling systems and more particularly to a novel ceiling panel that is designed to create a sinusoidal free form ceiling structure.

PRIOR ART

Suspended ceiling systems typically include grid members that provide for oppositely extending ceiling panel support flanges. The grid members are interconnected to form a grid and are suspended from the structure of a building with wire hangers or rods. In these systems, the edges of the ceiling panels are installed by laying the panels in the grid opening created by the grid members. Once the ceiling panels are installed into the grid, a uniform ceiling surface is created. Suspended ceiling panels are manufactured from gypsum or slag wool fiber and are designed to conceal pipes, wiring and the like, while still allowing access to the concealed space above the ceiling. Typical ceiling panels are fabricated out of sound deadening and insulating material and are designed to meet fire safety codes. The acoustical panels are planar in appearance and do little to enhance a room's décor. The acoustical panels also may include surface impressions and markings to enhance their appearance. When the panels are installed in the grid, the overall appearance of the ceiling is a generally planar. Prior art panels do not provide for a ceiling system that creates a sinusoidal free form ceiling structure.

SUMMARY OF THE INVENTION

This invention may be described as a novel ceiling panel that is used with a corresponding grid system to create a sinusoidal free form ceiling structure. The panels, when installed in the grid system create the appearance of moguls and are designed to enhance the appearance of retail and office space that utilize suspended ceilings to conceal the building structure. The free form ceiling is a grid system made up of curving tee members and preformed curved panels. The grid members curve in predefined radii into which formed panels are placed. The frame is formed from individual curved grid members that meet at their respective ends to form intersections. The grid members are rigid preformed members that are curved so that when interconnected a curve is formed. Alternatively, a standard planar grid system with variable length extension posts attached to the grid can be utilized to secure the free form panels. The panels are square when viewed in plan view but have a curved cross-section about all or part of the panels. The panels can be fabricated out of plastic, metal, glass reinforced gypsum, woven or non-woven mesh or fabric and can be opaque or translucent. In order to fill in the openings created by the sinusoidal grid members, the panels are rotated until they fit into their respective opening. The preferred panels are designed so that the four corners of the panel all lie in the same plane, although the corners can be designed to lie in independent planes. A ring shaped escutcheon can be used at grid member intersections to create openings in the ceiling system so, for example, a lighting or sprinkler system can be installed.

These and other aspects of this invention are illustrated in the accompanying drawings, and are more fully described in the following specification.

DETAILED DESCRIPTION OF THE INVENTION

While the present invention will be described fully hereinafter with reference to the accompanying drawings, in which a particular embodiment is shown, it is understood at the outset that persons skilled in the art may modify the invention. Accordingly, the description which follows is to be understood as a broad informative disclosure directed to persons skilled in the appropriate arts and not as limitations of the present invention.

Figure 1:
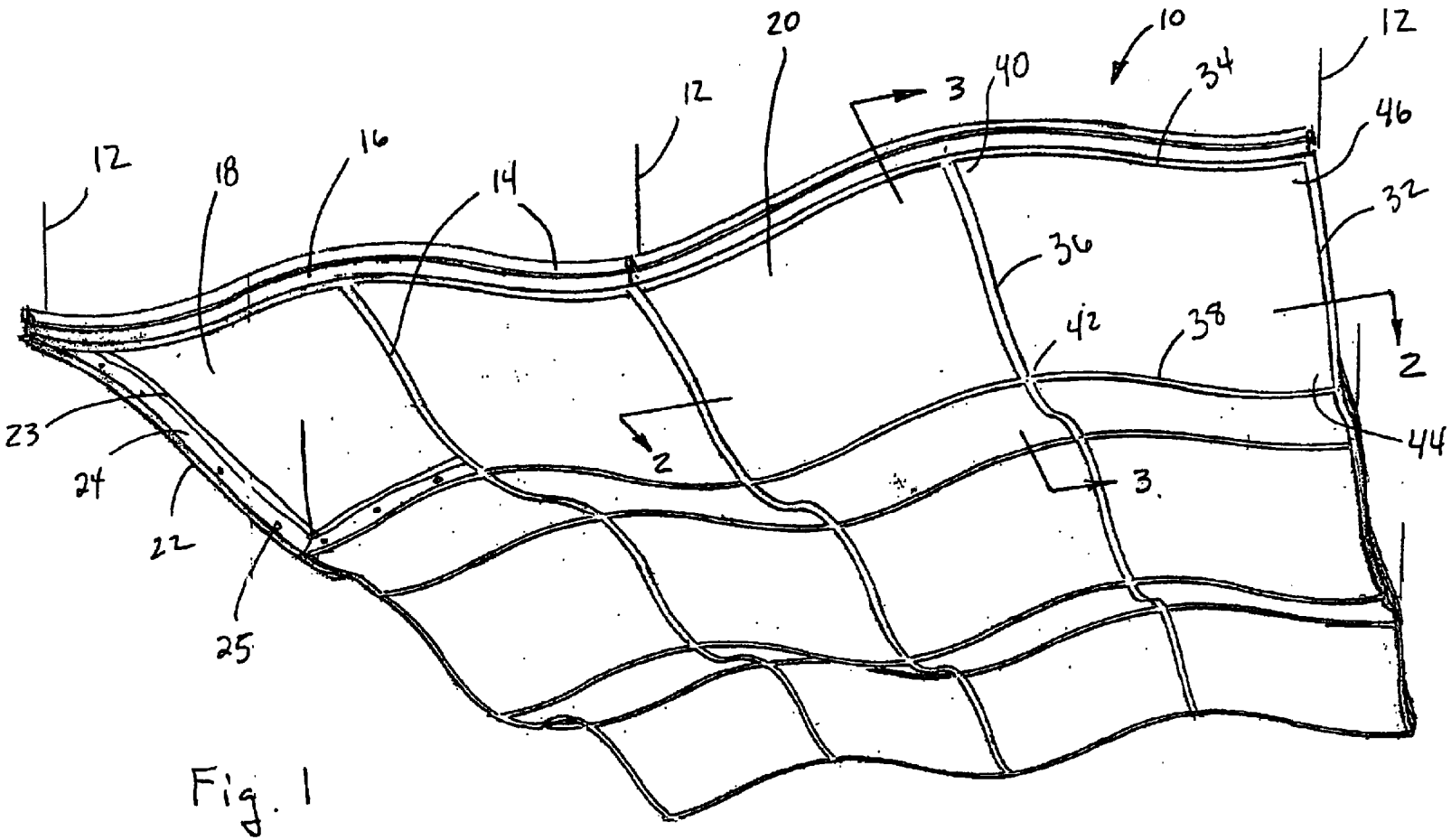
FIG. 1 is a perspective view of the free form ceiling as seen from below of the present invention suspended by wire hangers.

FIG. 1 illustrates a portion of an assembled free form ceiling system 10 suspended by wire hangers 12. The free form ceiling system 10 is comprised of curved grid members 14 that are interconnected to form a grid structure 16. The grid members 14 are arranged to form openings 18 sized to receive curved ceiling panels 20. The grid members 14 are suspended from the building structure by the wire hangers 12 or other supporting devices.

Figure 2:
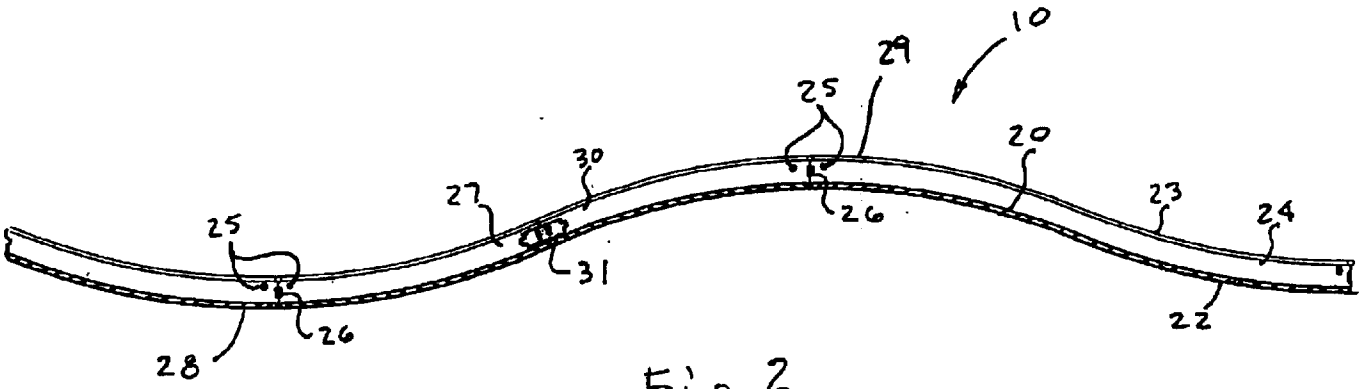
FIG. 2 is a cross section of FIG. 1 taken along line 2—2 illustrating the grid members.
Figure 3:
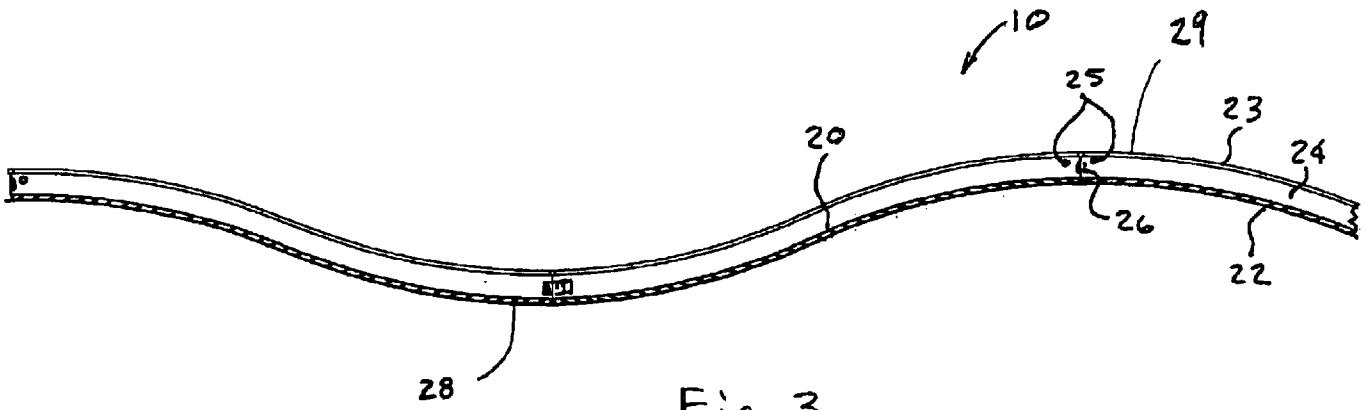
FIG. 3 is a cross section of FIG. 1 taken along line 3—3 illustrating the grid members.

The grid members 14, as shown in FIGS. 1–3, have a tee shaped cross section and include a horizontally oriented base member 22, a bulb portion 23 and a vertically oriented bridge member 24 that interconnects the base member 22 to the bulb portion 23. The base member 22 is connected to and perpendicularly oriented to the bridge member 24 and preferably has a width of 9/16 of an inch. The grid members 14 include a plurality of openings 25 and slots 26 to allow for the attachment of hanger devices 12 and the connection to other grid members 14. The slots 26 are spaced apart 24 inches on center. The grid members 14 are fabricated out of a die formed aluminum or steel and are curved during a secondary manufacturing process. The grid members 14 are curved into a low amplitude wave. The grid members 14 are manufactured in three preferred lengths, 8 feet, 4 feet, and 2 feet, although other lengths may be used. On a constructed grid 16, the main grid members 14 are typically longer than the cross grid members 14, which complete the grid 16. The curved sections create a plurality of crests 29, and valleys 28, as shown in FIG. 2. Each section of the grid members 14 include a first end 27 and a second end 30. The ends 27 and 30 are adapted to allow for the attachment of grid clips 31 so that one grid member 14 can be connected to the end of a second grid member 14.

To created the grid structure, a row of parallel evenly spaced grid members 14 are suspended by the wire hangers 12, as shown in FIG. 1. The grid members 14 are arranged so that the elevation of the crests 26 and valleys 28 in each row are equal. Each row of grid members 14 are dimensioned to accommodate the size of the curved ceiling panels 20. To accommodate a 2-foot by 2-foot ceiling panel, the grid members 14 would be spaced apart 2 feet on-center. The free form grid structure 16 also includes a second set of grid members 14 that are perpendicularly oriented in relation to the first set of grid members 14 to create the opening required for suspending the panels 20.

Figure 12:
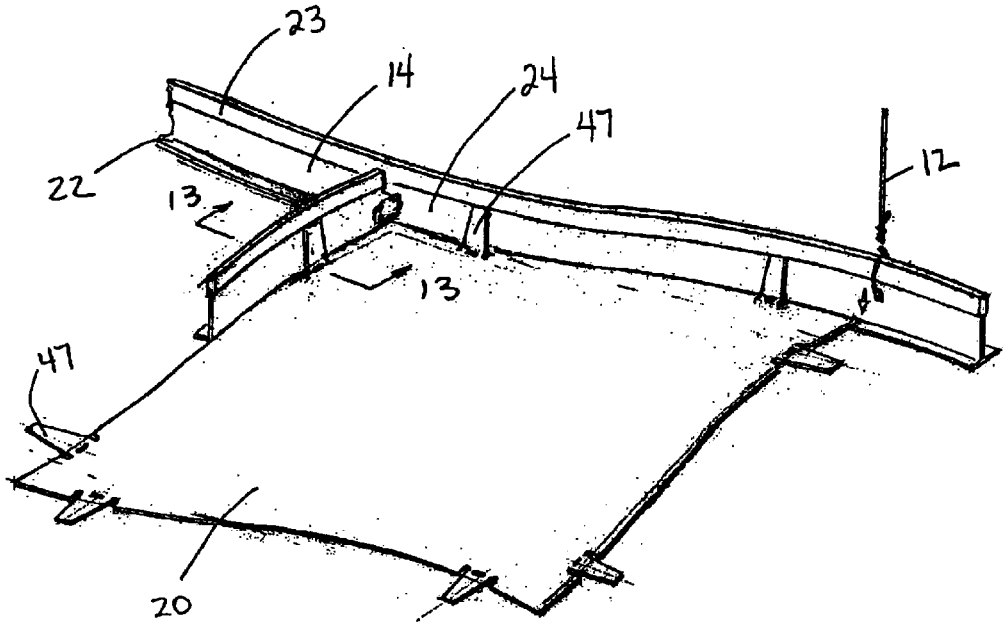
FIG. 12 is a perspective view of the free form ceiling illustrating one type of connection of the panel to the grid.
Figure 13A:
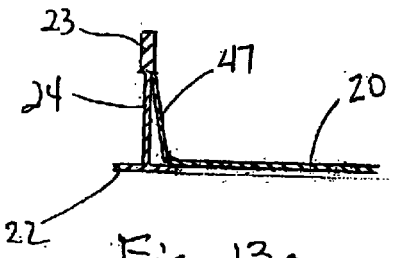
FIG. 13*a* is a cross-section of FIG. 12 taken along line 13—13.
Figure 13B:
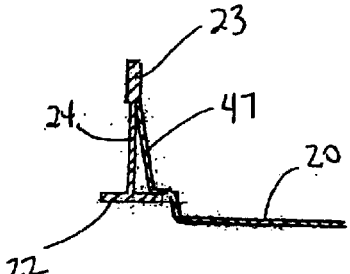
FIG. 13*b* is a cross-section of the free form ceiling showing the grid member and an alternate panel edge configuration.
Figure 14:
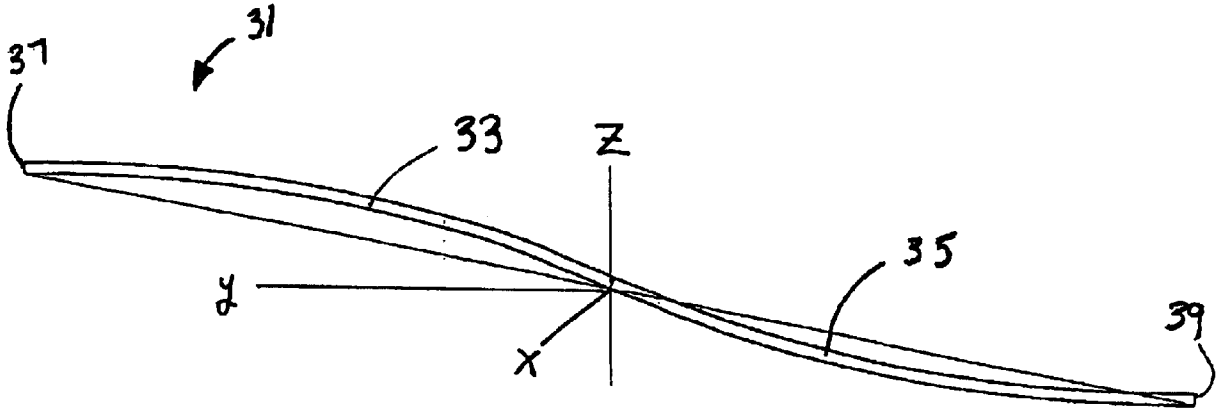
FIG. 14 is a cross-section of an alternate ceiling panel of the present invention.
Figure 15:
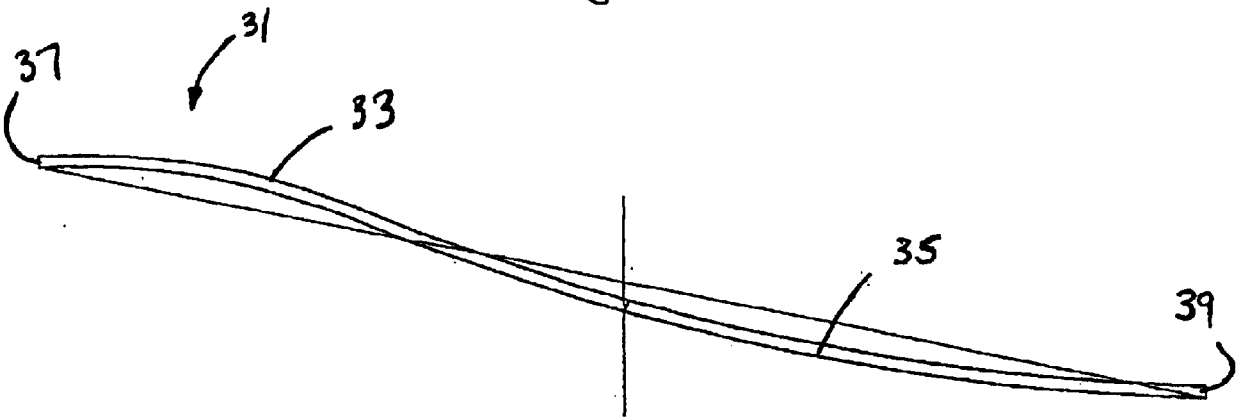
FIG. 15 is a cross-section of an alternate ceiling panel of the present invention.

The free form ceiling panels 20 have a square appearance when viewed in plan view but have a curved cross-section about all or part of the panel, when viewed in cross-section. The panels are preferably square but other geometric shapes can be used such as rectangular and triangular. The panels 20 can be fabricated out of plastic, metal, glass reinforced gypsum, woven or non-woven mesh or fabric and can be opaque or translucent. Plastic panels, typically polycarbonate, are thermoformed and metal panels are pressed to form the desired shape. In order to fill in the openings 18 created by the grid members 14, the panels are rotated until they fit into their respective opening 18, as shown in FIG. 1. The panels 20, if designed with equal crest and valley radius, have the four corners of the panel all lying in the same plane. Variations in the radius of the crest 33 and valley 35 of the panels 20 vary the orientation of the corners 37 and 39 of the panels 20 with respect to each other as shown in FIGS. 14 and 15. For square or rectangular panel systems, a repeating grid configuration allows one panel design to be used for filling an entire grid structure. The panels 20 include four edges 32, 34, 36 and 38, wherein each edge is supported by the base 22 of the grid members 14 as shown in FIG. 1. The panels 20 also include four corners 40, 42, 44 and 46 that can have end points all lying in the same plane. The edges 32, 34, 36 and 38 form low amplitude waves and are designed so that a single panel design can be used to fill the various grid openings 18. The panels 20 are secured to the grid using individual clips 47 that are installed over the bulb portion 23 to hold the panels 20 into position. Alternatively, integral panel clips 47 that extend outwardly from the edges 32, 34, 36 and 38 of the panels 20 can be used to secure the panel to the bulb portion 23 to position the panel 20 tightly along the base member 22 of the grid 14 as shown in FIGS. 12, 13*a* and 13*b*.

Figure 4:
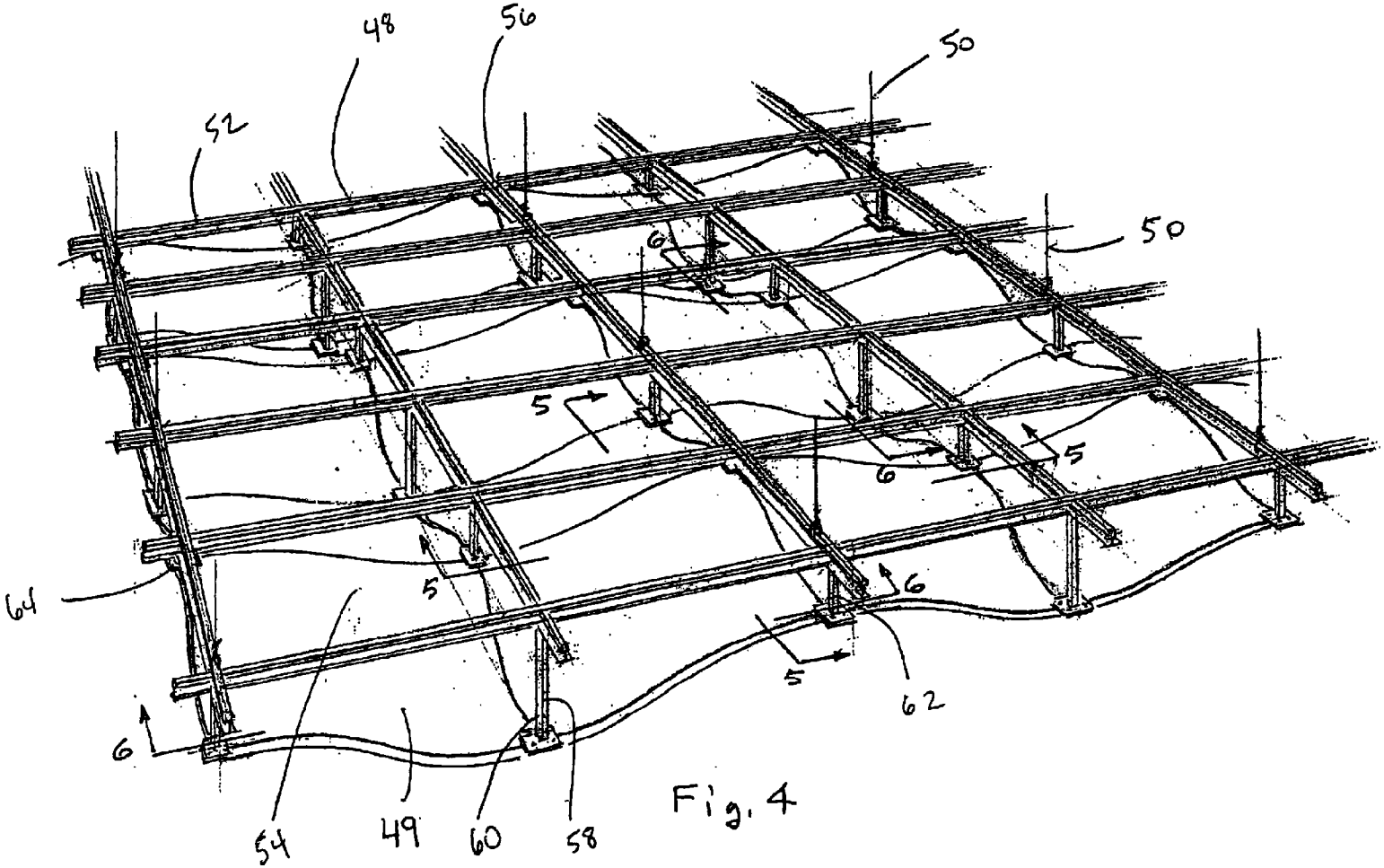
FIG. 4 is a perspective view as seen from above of an alternate embodiment of the free form ceiling illustrating the use of a planar grid system incorporating variable length posts to suspend the panels.

FIG. 4 illustrates an alternate embodiment of the free form ceiling system 10 wherein a planar ceiling grid system 48 is utilized to support the panels 49. The grid system 48 is supported to a building structure by wire hangers 50, rods or other support devices. The grid system 48 is formed from linear grid members 52 that are positioned in a first set of evenly spaced rows that are perpendicularly oriented to a second set of evenly spaced rows to form a plurality of grid openings 54 and grid intersections 56. Extending downwardly from the grid intersections are a plurality of extension members 58. The extension members 58 are fabricated in three lengths a long member 60, an intermediate length member 62 and a short member 64.

Figure 5:
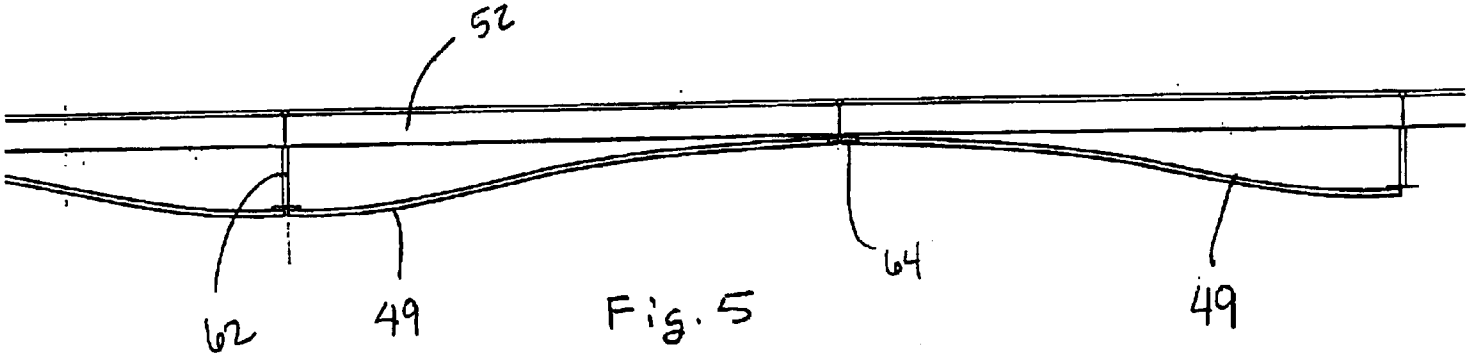
FIG. 5 is a cross section of FIG. 4 taken along line 5—5 illustrating the panels suspended from the variable posts.

FIG. 5 illustrates a cross-section 5—5 taken of FIG. 4 illustrating the linear grid members 52 spanning above the panels 49. The panels 49 are connected to the grid members 52 by the intermediate length and the short extension members 62 and 64. The extension members 58 are positioned at each of the grid intersections 56 and are adapted to connect the corners of four separate panels 49. To properly attach the panels 49 to the grid system 48, each panel 49 is connected with extension members 58.

Figure 6:
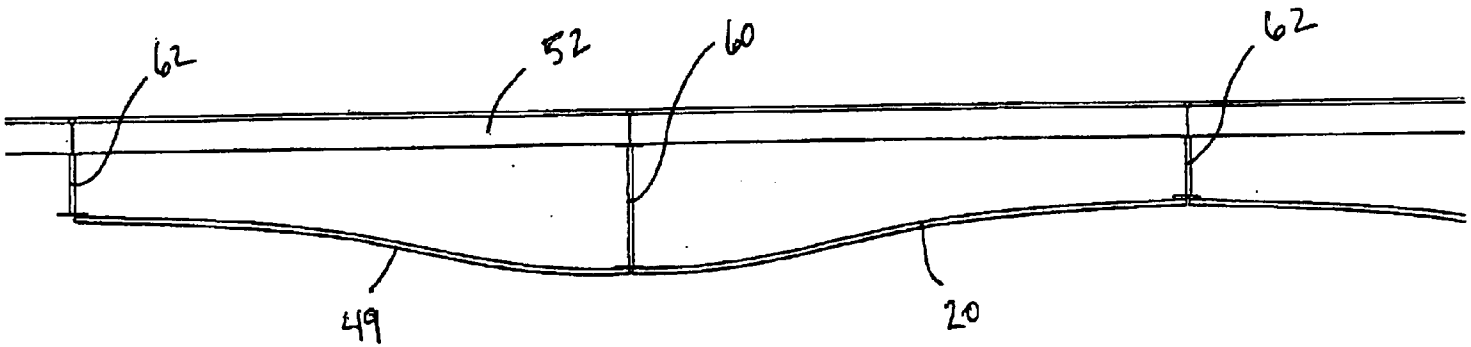
FIG. 6 is a cross section of FIG. 4 taken along line 6—6 illustrating the panels suspended from the variable length posts.

FIG. 6 illustrates a cross-section 6—6 taken of FIG. 4 illustrating the linear grid members 52 spanning above the panels 49. The panels 49 are connected to the grid members 52 by the intermediate length and the long extension members 62 and 60. The extension members 58 are positioned at each of the grid intersections 56 and are adapted to connect the corners of four separate panels 49.

Figure 7:
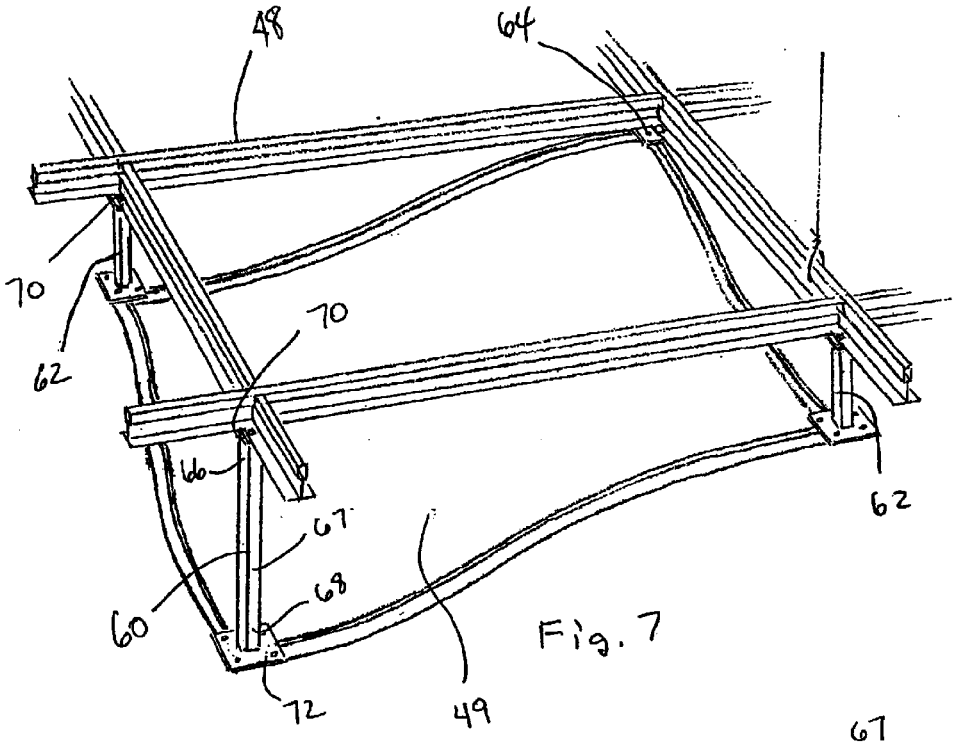
FIG. 7 is a perspective view of the alternate embodiment of the free form ceiling illustrating the variable length posts suspending the panel from a planar grid.

FIG. 7 illustrates the free form ceiling panel 49 suspended from a linear grid system 48. The extension members 60 and 62 include tube shaped member 67 that includes an upper end 66 and a lower 68. The tube shaped member 67 is preferably fabricated from aluminum or steel square tube stock, but other materials can be used known to those skilled in the art. The upper end 66 includes a grid clip 70 that allows attachment of the extension members 60, 62 and 64 to the base member 22 of the grid members 52. The lower end 68 of the extension members 60, 62 and 64 include a connector plate 72 that allows for the attachment of the suspension panels 49. The short extension members 64 do not require a tubular shaped member 67 since the grid clip 70 mounts directly to the connector plate 72.

Figure 8:
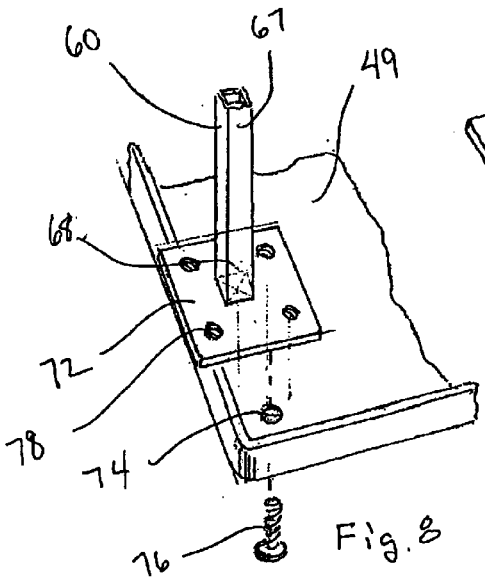
FIG. 8 is an exploded view of the panel and its connection to a post.
Figure 9:
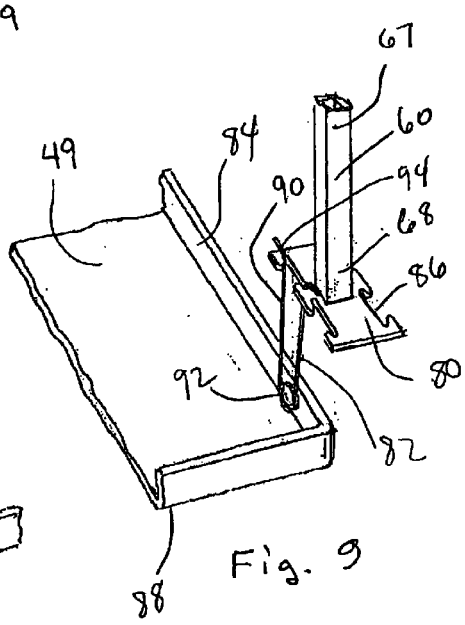
FIG. 9 is an exploded view of the panel illustrating an alternate panel connecting mechanism.

FIGS. 8 and 9 illustrate two variations in the connector plates 72 and 80 to allow for connection of the panels 49. The first connector plate 72, illustrated in FIG. 8 utilizes a square plate 72 with four threaded apertures 78 to allow the panel 49 to be attached by a fastener 76. The fastener 76 passes through an aperture 74 in the corner of the panel 49 and threadably engages the aperture 78, locking the panel 49 to the extension member 60. The second connector plate 80 is also connected to the lower end 68 of the extension member 60 and includes a spring clip channel 86 that is adapted to accept spring clip 82. The spring clip 82 is mounted to a side 84 of panel 49 (as shown in FIG. 9). The spring clip arrangement allows the bottom surface 88 of the panel 49 to be void of fasteners to create clean, uninterrupted surface when viewed from below. The spring clip 82 is a V-shaped member that includes two upwardly extending support wires 90 and is connected at its based to a support pin 92 on the side 84 of the panel 49. The support wires 90 are flared outward to provide a biasing force to retain the panel 49 in the closed position. The upper ends of the support wires 90 include retaining ends 94 to support the panel 49 when it is in the open position. To lower the panel 20, a downward force is applied to the panel 20 to overcome the biasing force of the support wires 90. The panel 49 will continue to move downward until the retaining ends 94 contact the connector plate 80. To remove the panel 20, the support wires 90 are squeezed so that the retaining ends 94 clear the spring clip channel 86.

The panels 49 can also be suspended without the use of a grid by connecting the panels 49 to the short extension members 64 and suspending the extension members 64 from the building structure with hangers 12. Also, the panels 64 can be interconnected with clips and suspended to the building structure by attaching the hangers 12 to the panels 49.

Figure 10:
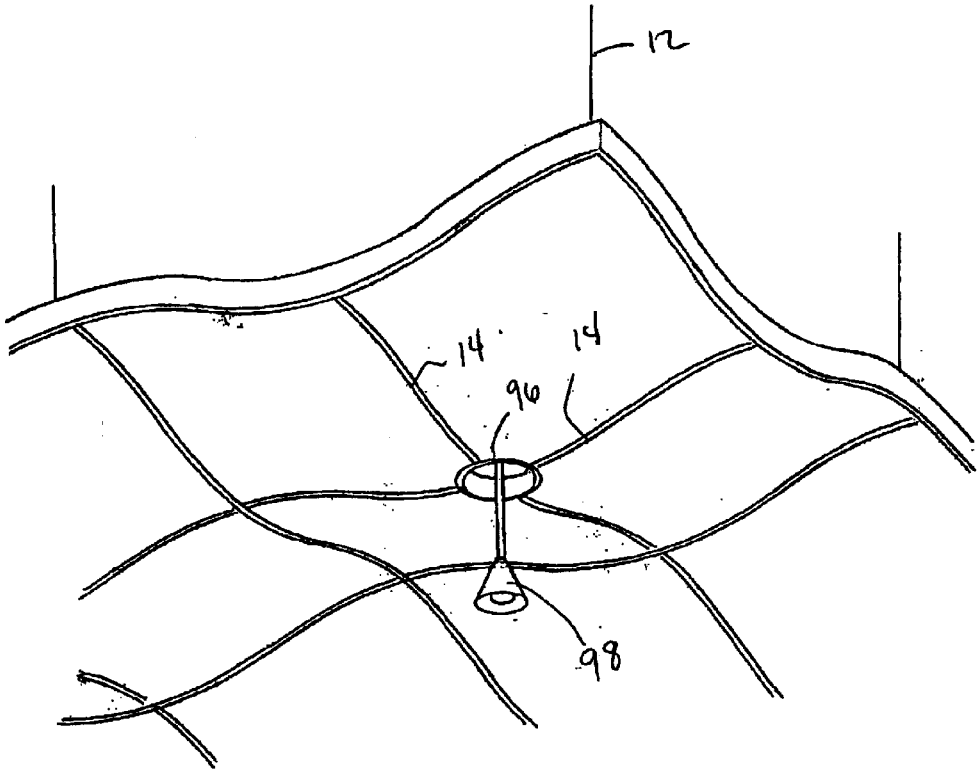
FIG. 10 is a perspective view of the free form ceiling of the present invention illustrating the use of an escutcheon at an intersection to allow for the installation of electric lighting.
Figure 11:
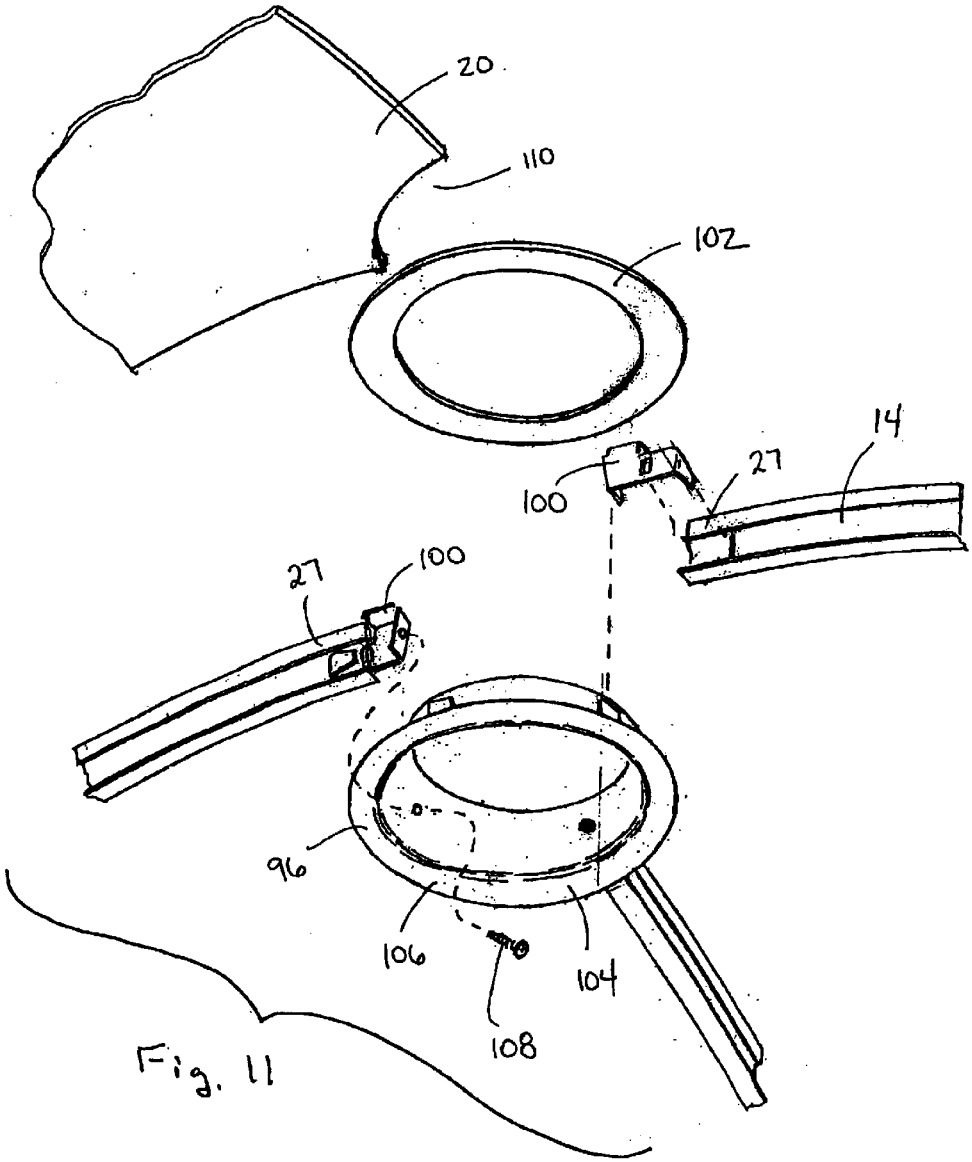
FIG. 11 is an exploded view of an escutcheon connected at a grid intersection.

FIGS. 10 and 11 illustrate a ring-shaped escutcheon 96 positioned at the intersection of four grid members 14. The escutcheon 96 allows for lighting 98, sprinkler heads or other items that need to pass through the ceiling system 10. The opening is formed by using four grid members 14 that are slightly shortened to accommodate the escutcheon 96. Clips 100 are installed at the ends 27 of the grid members 14, to provide an attachment surface for the escutcheon 96. The escutcheon 96 is comprised of a ring portion 102. The cup portion 104 is connected to the clips 100 by use of fasteners 108. The panels 20 are modified by removing a corner section creating an opening 110 in the panel.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A curved panel suspension ceiling system comprising:

a plurality of curved grid members intersecting to form a grid, said grid adapted to be suspended from a building structure;

a plurality of curved ceiling panels adapted to be connected to said grid; each of said curved ceiling panels including a body portion having four endpoints;

four edges that are curved such that the actual length of said side edges between two of said endpoints is longer that the linear distance between said endpoints along said side edges: and said body portion of said curved ceiling panels curve upward and downward, deviating from a common plane in three dimensional axes.

2. The curved panel suspension ceiling system of claim 1, wherein said curved ceiling panels include clips adapted to retain said panel to said grid.

3. The curved panel suspension ceiling system of claim 1, further comprising an escutcheon positioned at the intersection of said grid members, said escutcheon adapted to allow for the passage of elements from above said ceiling system.

4. A curved panel suspension ceiling system comprising:

a plurality of grid members having a base portion, said plurality of grid members intersecting to form a grid, said grid adapted to be suspended from a building structure;

a plurality of curved ceiling panels adapted to be connected to said grid and supported by said base portion of said plurality of grid members; each of said curved ceiling panels including a body portion having four endpoints;

four edges that are curved such that the actual length of said side edges between two of said endpoints is longer that the linear distance between said endpoints alone said side edges; and said body portion of said curved ceiling panels curve upward and downward, deviating from a common plane in three dimensional axes.

5. The curved panel suspension ceiling system of claim 4, wherein said plurality of grid members are linear.

6. The curved panel suspension ceiling system of claim 5, wherein said plurality of curved ceiling panels are connected to said grid members by extension posts.

7. The curved panel suspension ceiling system of claim 6, wherein said extension posts connect to said grid at the intersections formed by said grid members.

8. A curved panel suspension ceiling system comprising:

a plurality of curved grid members intersecting to form a grid, said grid adapted to be suspended from a building structure;

a plurality of ceiling panels having a body portion curved in three dimensional axes, said ceiling panels adapted to be connected to said grid;

said body portion of said ceiling panels curve upward and downward, deviating from a common plane.

9. The curved panel suspension ceiling system of claim 8, wherein said plurality of curved grid members include a base portion that is adapted to support said plurality of curved ceiling panels.

10. The curved panel suspension ceiling system of claim 8, wherein said ceiling panels include clips adapted to retain said ceiling panels to said grid.

11. The curved panel suspension ceiling system of claim 8, further comprising an escutcheon positioned at the intersection of said curved grid members, said escutcheon adapted to allow for the passage of elements from above said ceiling system.

12. The curved panel suspension ceiling system of claim 8, wherein said ceiling panels are fabricated out of material selected from a group consisting of plastic, metal, resin, wood fiber, gypsum, fabric, woven mesh, and non-woven mesh.

* * * * *